US005201125A

United States Patent [19]

Shorten

[11] Patent Number: 5,201,125

[45] Date of Patent: Apr. 13, 1993

[54] SHOE, ESPECIALLY A SPORT OR REHABILITATION SHOE

[75] Inventor: Martyn R. Shorten, Portland, Oreg.

[73] Assignee: Tretorn AB, Helsingborg, Sweden

[21] Appl. No.: 707,865

[22] Filed: May 31, 1991

[30] Foreign Application Priority Data

May 31, 1990 [DE] Fed. Rep. of Germany ... 9006188[U]

[51] Int. Cl.[5] ..... A43B 13/20; A43B 13/18

[52] U.S. Cl. ..... 36/29; 36/28

[58] Field of Search ..... 36/28, 29, 59 C, 71, 36/3 B, 44, 143, 144; 428/116, 118; 5/435, 442, 444, 452, 455, 464, 476, 481

[56] References Cited

U.S. PATENT DOCUMENTS

| | | | |
|---|---|---|---|
| 532,429 | 1/1895 | Rogers . | |
| 1,559,532 | 10/1925 | Smith . | |
| 3,738,373 | 6/1973 | Glancy | 36/144 |
| 3,876,493 | 4/1975 | Gilmore | 36/71 |
| 4,241,465 | 12/1980 | Yarimie et al. | 5/452 |
| 4,291,080 | 9/1981 | Ely et al. | 428/116 |
| 4,472,890 | 9/1984 | Gilbert | 36/28 |
| 4,485,568 | 12/1984 | Landi et al. | 36/44 |
| 4,583,338 | 4/1986 | Sewell et al. | 428/116 |
| 4,970,807 | 11/1990 | Anderie et al. | 36/28 |
| 5,005,300 | 4/1991 | Diaz et al. | 36/28 |
| 5,084,987 | 2/1992 | Flemming | 36/28 |
| 5,092,060 | 3/1992 | Frachey et al. | 36/28 |

FOREIGN PATENT DOCUMENTS

| | | | |
|---|---|---|---|
| 513375 | 10/1939 | United Kingdom | 36/59 C |

*Primary Examiner*—Steven N. Meyers

*Attorney, Agent, or Firm*—Sixbey, Friedman, Leedom & Ferguson

[57] ABSTRACT

A shoe, especially a sport or rehabilitation shoe, is formed with at least one recess. In the at least one recess is contained an insert. The insert is comprised of a honeycomb body of elastic compressible material. The honeycomb cells increase in surface area from one side edge of the honeycomb body to an opposite side edge of the body as seen in a top view thereof.

19 Claims, 3 Drawing Sheets

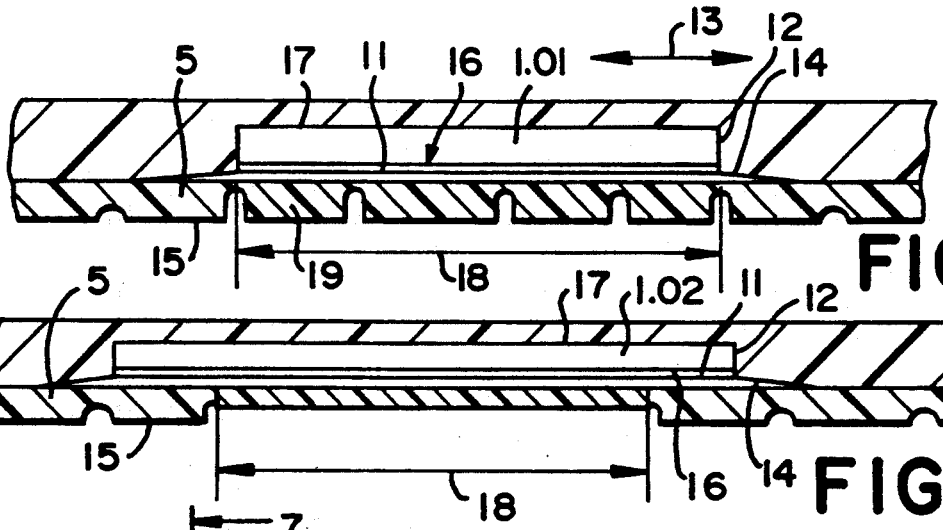
FIG. 6
FIG. 7
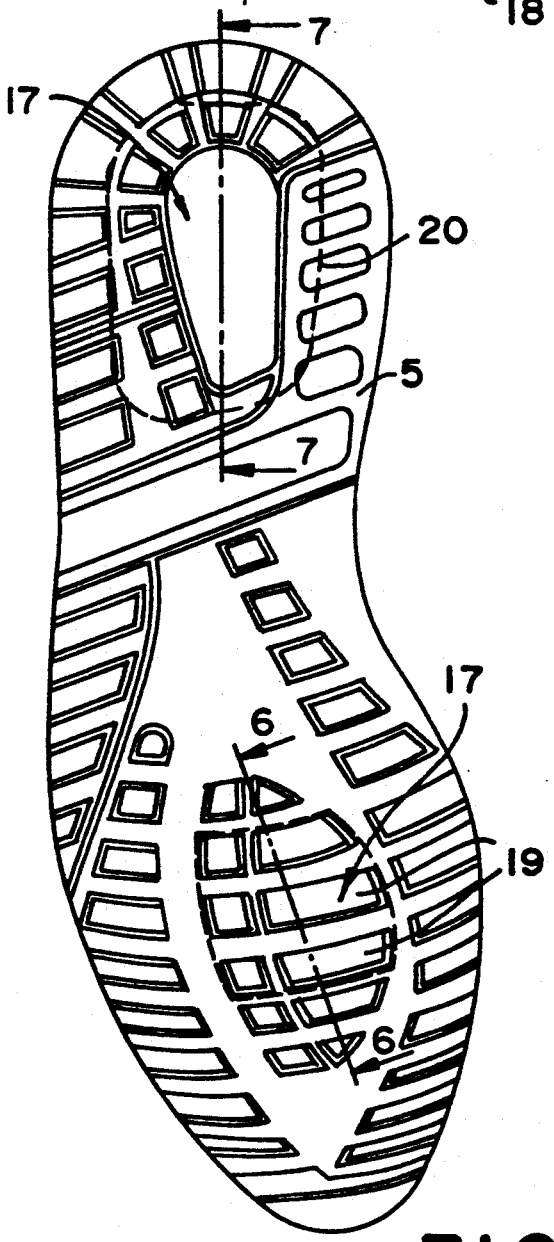
FIG. 8
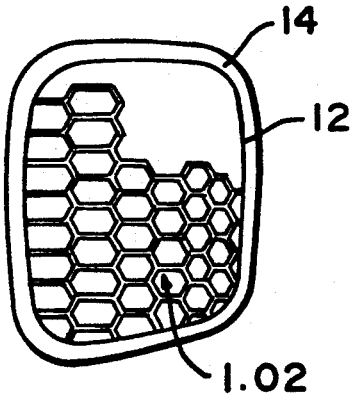
FIG. 9
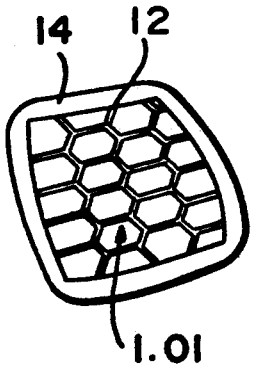
FIG. 10

SHOE, ESPECIALLY A SPORT OR REHABILITATION SHOE

BACKGROUND OF THE INVENTION

This invention relates to a shoe, especially a sport shoe or rehabilitation shoe with a shoe sole with at least one insert part formed of a honeycomb body of elastic compressible material, and having cells with central axes that run at least approximately perpendicular to the plane of the shoe sole.

From U.S. Pat. No. 4,485,568, an insole for a shoe is known, which exhibits a honeycomb structure. The upper side of this insole consists of an air-permeable material and the underside of a thin backing. On the peripheral edge, the honeycomb cells, which are applied between the foamed padding (upper side) and the thin backing, are at least partially open, since the honeycomb body is produced from undulating or meander-shaped strips glued together with the walls and then stretched so that honeycomb cells of longitudinally extended rectangular form result. Such honeycomb bodies, as a result of the laterally open edge honeycomb cells, have a greatly decreasing damping toward the edge, so that the restoring force of such a honeycomb body in the edge areas tends almost toward zero. This is not favorably influenced or compensated for even by the upper side and underside joined on the edge. For an insole, this result is not very disturbing, since the form of the insole generally corresponds, approximately, to the projection of the foot on the shoe bottom and the edge of the insole hardly serves for supporting of the foot.

Cushion soles are also known (see, for example, U.S. Pat. Nos. 532,429 and 1,559,532) in which honeycomb air cushion inserts are provided in heel and forefoot regions of an insole or outsole. In these cushion soles, the peripheral cells of the insert are closed at their side edges; however, the ends of the cells are open and the insert is disposed in or on another sole layer to produce an air cushion effect. Also, the cells or partial cells at the periphery of the cushion inserts are smaller than the other cells, which are all of the same size.

With known honeycomb structures, since all of the honeycomb cells are designed in the same way, except at the edge area, the damping and restoring force are essentially uniform, except for at an edge or narrow peripheral area.

SUMMARY OF THE INVENTION

The primary object of this invention is to attain a shoe, especially a sport shoe or rehabilitation shoe, of the initially mentioned type, in which, in the area of the heel, the honeycomb body is structured so that it counteracts pronation or supination of the foot of a wearer and promotes a stabilizing of the foot in running.

This object is achieved by the honeycomb body being provided in an area under the heel and having honeycomb cells which increase in their surface extension or surface area from one side edge to an opposite side edge of the honeycomb body, across the sole or midsole of the shoe, as seen in a top view thereof.

According to the invention, the stiffness of the honeycomb insert and its degree of damping is changed from one side of the insert part to its other side so that an outward or inward twisting of the foot is counteracted.

Other advantageous details of the invention are are described below in greater detail with reference to the embodiments illustrated in the drawings.

BRIEF DESCRIPTION OF THE DRAWINGS

FIG. 6 shows a segment of a longitudinal section of the sole taken along 6—6 in FIG. 8 with a honeycomb body insert in the area of the forefoot shown in elevation;

FIG. 7 shows a segment of a longitudinal section of the sole taken along line 7—7 in FIG. 8 with honeycomb body insert in the heel area shown in elevation;

FIG. 8 is a view of the tread surface of the sole; and

FIGS. 9 and 10 show top plan views of a respective honeycomb body for each of the forefoot and heel areas.

DETAILED DESCRIPTION OF THE PREFERRED EMBODIMENTS

Figure 1:
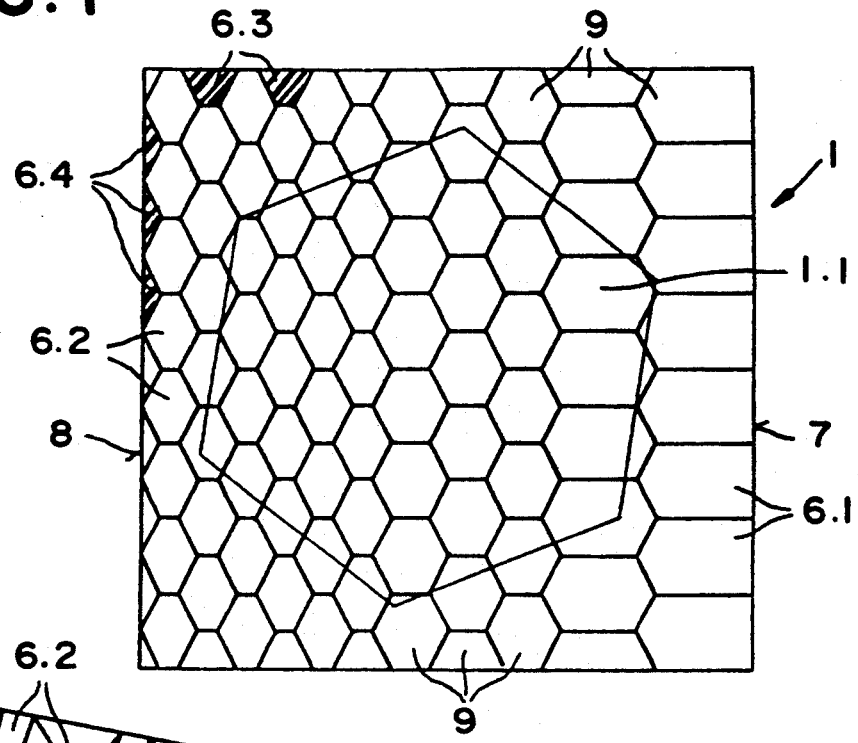
FIG. 1 is a top view of a honeycomb body according to the invention, from which a prefabricated section is placed as an insert under the heel bone in the shoe sole or in the midsole.
Figure 2:
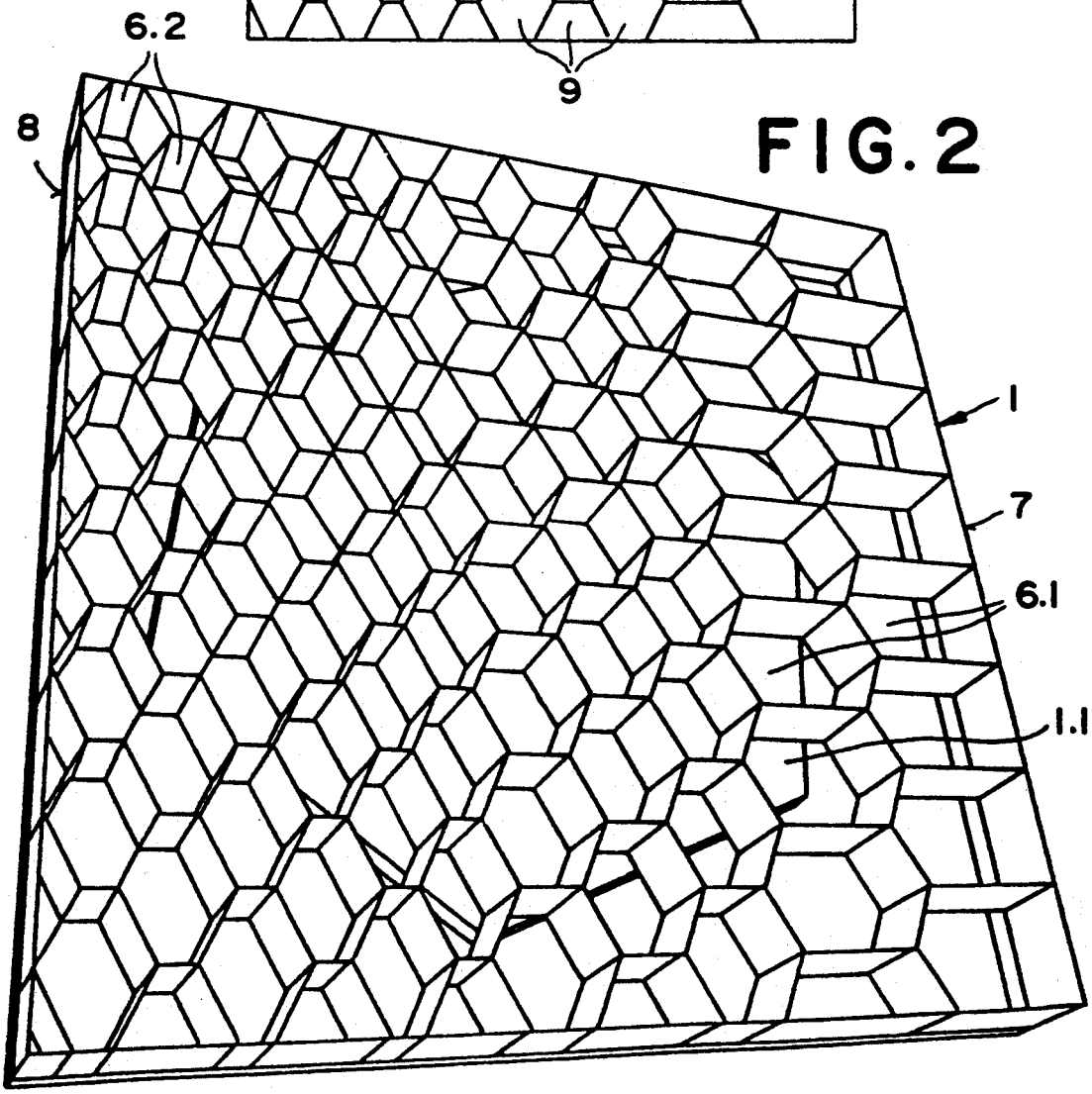
FIG. 2 is a perspective view of the honeycomb body according to FIG. 1.

In FIGS. 1 and 2, a segment of a honeycomb body 1 is indicated from which, for example, a portion 1.1 is cut out for use, in area 2 under the heel (FIGS. 3 and 4), as an insert in a recess 4 of a sole or a midsole 5.

Figure 3:
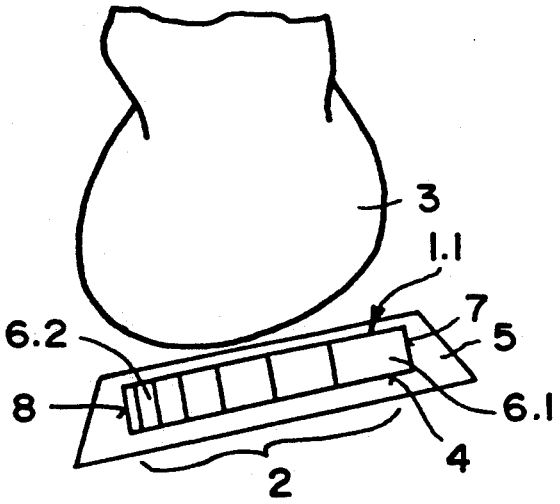
FIG. 3 is a rear view of a right foot with a tendency to pronation (with a view window for the honeycomb body) and the corresponding compensating design of the honeycomb body.
Figure 4:
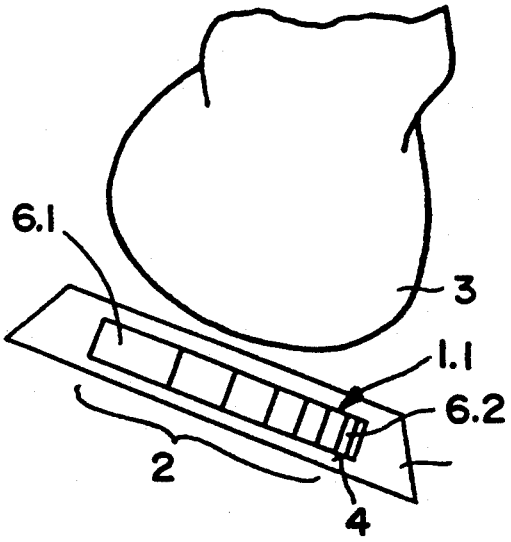
FIG. 4 is a rear view of a right foot with a tendency to supination (with a view window for the honeycomb body) and the corresponding compensating design of the honeycomb body.

The honeycomb cells are designed so that, in top view, the surface area of honeycomb cells 6.1 decreases from a side 7 to honeycomb cells 6.2 of the opposite side 8, represented in FIGS. 1, 2 and 3 from right to left. As a result, the stability of honeycomb body 1 increases from right to left. This embodiment of honeycomb body 1 is, preferably, suitable for a user, whose right leg according to FIG. 3, looked at from behind, tends toward pronation, i.e., to twisting inward. The higher stability at the left (inner or medial) side acts to counteract this pronation. Conversely, with a user whose right leg, according to FIG. 4, tends toward supination, i.e., to twisting outward, the stability on the right (outer or lateral) side is increased, by honeycomb body 1 having honeycomb cells 6.1 with greater stability and smaller surface area on the right in the top view according to FIGS. 1 and 2.

The design can be selected so that the surface area of the honeycomb cells increases or decreases from one side 7 to the other side 8 by steps or continuously.

Figure 5:
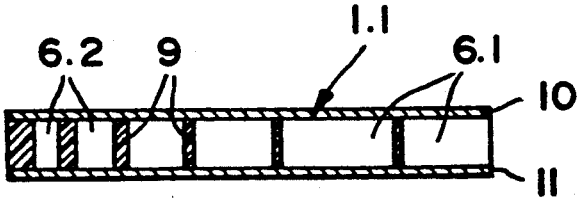
FIG. 5 is a cross section of a honeycomb body with additionally changed stability of its honeycomb walls.

An increase of the stability of the honeycomb cells can also be achieved in that, according to FIG. 5 the wall thickness of honeycomb walls 9 is increased toward one side. The change of wall thickness 9 can also take place either by steps or continuously.

Preferably, honeycomb cells 6.1, 6.2 are almost or completely gastight within sole or midsole 5, and honeycomb body 1 can be provided with an upper and lower covering layer 10 or 11 for achieving this result (FIG. 5).

Honeycomb body 1 consists of an elastic, compressible material, for example of polyethylene, polyurethane, polyether or the like, and can be produced, for example, by an injection molding process, or can be extruded and then separated from the extrudate as a disk. Honeycomb body 1, is initially open at its top and bottom, and is inserted as a finished part in recess 4 of sole or midsole 5. The upper and lower covering layers 10, 11 close the individual honeycomb cells gastight or practically gastight.

Further, it is advantageous if honeycomb body 1 is provided with upper and lower covering layers 10, 11, which cover and close gastight honeycomb cells 6.1, 6.2 over the entire honeycomb body 1. This embodiment has the advantage that the honeycomb body can be injection molded with any honeycomb configuration or honeycomb size, and provision can be made for a complete gastight closing of the honeycomb body by the later addition of the upper and lower covering layers 10, 11.

Finally, it is very advantageous if incomplete honeycomb cells 6.3., 6.4 in outermost, peripheral, honeycomb rows are filled with a compact, unfoamed elastic material. In connection with the gastight closing of the honeycomb cells, this embodiment offers the important advantage that, even in the edge area of prefabricated honeycomb body 1, there is a sufficiently high restoring force, which provides for an optimal damping over the entire surface of honeycomb body 1.

According to an advantageous configuration of the invention represented in FIGS. 6 to 10, honeycomb body 1, on edge 12, is provided with an edge flange 14 which projects from edge 12 in directions 13 parallel to the plane of the sole. Sole 5 is comprised of a midsole **5*a* and an outsole 5*b*, with the honeycomb body 1 being received in midsole 5*a* and solidly bonded, for example, vulcanized, glued or hot-sealed to outsole 5*b* by this edge flange 14. The production takes place, for example, so that the side 16 of honeycomb body 1 facing tread surface 15 of outsole 5*b* is provided with a cover layer 11, or this cover layer 11 is co-molded in the production of honeycomb body 1 and this honeycomb body 1 is inserted in a sole injection mold. In the injection molding of sole 5, the sole material can be bonded to the material of edge flange 14**. In this way, a one-piece, practically homogeneous outsole is obtained from different molded parts.

As materials for sole 5, honeycomb body 1 and cover layer 11, preferably, similar materials are used, which bond well to one another. For example, these sole parts are made of rubber, a rubber-plastic mixture or plastic. With a sufficiently thick cover layer 11, it can serve directly as a part of the tread surface. In this case, sole 5, produced in the sole injection mold, has a recess 17, which is not filled with sole material.

In the embodiments according to FIGS. 6 and 7, cover layer 11 is covered by the sole material and these sole parts are solidly bonded to one another, for example, by vulcanization, especially by suitable selection of the materials of sole 5 and cover layer 11.

In the embodiment represented in FIG. 6, which shows a segment of a longitudinal section in the forefoot area of the sole of FIG. 8, the surface of area 18 of sole 5 corresponds precisely to the surface of honeycomb body 1.01, the periphery of which is represented by a broken line in the forefoot area of the sole in FIG. 8 and which is shown in greater detail in FIG. 10. In area 18, sole material is formed on cover layer 11 in the form of gripping elements 19. Preferably, transparent material is used for cover layer 11 and sole 5 in area 18, so that the structure of honeycomb body 1 is visible from the outside. In this way, it can immediately be determined for which type of running of a user a shoe with such a sole 5 is suitable.

Honeycomb body 1 can also be greater than area 18, as represented by FIG. 7. This figure shows a longitudinal section of a segment of the heel area of FIG. 8. Area 18 is smaller in the surface extension than the surface of honeycomb body 1.02 represented in FIG. 9, as represented in broken lines by peripheral surface line 20 in FIG. 8 in the heel area. Area 18, in this case, is not provided with gripping elements and its outer surface is recessed in relation to the tread surface 15. In this way, an increased damping is achieved.

It has turned out to be advantageous to coordinate the degree of hardness of honeycomb body 1, sole 5 and area 18 of sole 5 to one another. In particular, the cover layer 11 or the sole material covering it should be selected as the softest and honeycomb body 1 as the hardest. The following were determined as advantageous degrees of hardness of the individual materials:

| | |
|---|---|
| Honeycomb body: | Shore A about 63 to 65, |
| Sole: | Shore A about 60, |
| Cover layer or sole material covering it: | Shore A about 56 to 58. |

The shoe according to the invention is especially preferred as a sport shoe that can be used for all types of sports, in which the pronation or supination of the foot position of the user must be countered and a stabilizing of the foot during running is to be promoted. By the embodiment according to the invention with a prefabricated honeycomb body 1, a flat positioning of the foot is achieved as quickly as possible, which means that both pronation and supination to a harmful extent is avoided. Thus, the shoe according to the invention is also suitable as a rehabilitation shoe, since subsequent injuries because of pronation or supination can be ruled out at least for the most part.

While we have shown and described various embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

I claim:

1. Shoe, especially sport shoe or rehabilitation shoe, with a shoe sole comprising at least one sole layer with at least one insert part formed of a honeycomb body made of elastic compressible material, and having honeycomb cells with central axes that run at least approximately perpendicular to a plane parallel to said sole layer; wherein the honeycomb body is provided in the sole layer in an area positioned under the heel of a wearer; and wherein the honeycomb cells increase in surface area from one side edge of the honeycomb body to an opposite side edge of the honeycomb body, across the sole, as seen in a top view thereof.

2. Shoe according to claim 1, wherein the increase in the surface area of the cells occurs continuously.

3. Shoe according to claim 1, wherein honeycomb body has a cover layer on a side facing a tread surface of the sole; wherein an edge of the honeycomb body has a peripheral edge flange which projects parallel to said plane; and wherein the edge flange is solidly bonded to the sole.

4. Sole according to claim 3, wherein the sole is transparent in an area of at least part of the cover layer.

5. Shoe according to claim 4, wherein the surface area of the honeycomb body is greater than that of the transparent area of the sole.

6. Shoe according to claim 5, wherein the sole has gripping elements molded on an area covering the honeycomb body.

7. Shoe according to claim 3, wherein the honeycomb body is formed of a material whose degree of hardness is greater than that of the sole layer and cover layer; and wherein the cover layer has a degree of hardness which is less than that of sole layer.

8. Shoe according to claim 7, wherein the material of the honeycomb body has a degree of hardness of about Shore A 63 to 65, the material of sole layer has a degree of hardness of about Short A 60 and the material of the cover layer has a degree of hardness of about Shore A 56 to 58.

9. Shoe according to claim 3, wherein the honeycomb body is disposed in a midsole layer and said flange is bonded to an outside layer.

10. Sole according to claim 3, wherein the sole layer extends over the entire cover layer and is solidly bonded to the cover layer.

11. Shoe according to claim 10, wherein the honeycomb body and the sole layer are formed of similar materials which are able to be bonded to one another by a molding process.

12. Shoe according to claim 1, wherein the honeycomb body and the sole layer are formed of similar materials which are able to be bonded to one another by a molding process.

13. Shoe according to claim 1, wherein the sole has gripping elements molded on an area covering the honeycomb body.

14. Shoe according to claim 1, wherein a wall thickness of walls defining the honeycomb cells decreases in correspondence with the increase of the surface area of honeycomb cells.

15. Shoe according to claim 1, wherein the honeycomb cells are least approximately gastight.

16. Shoe according to claim 1, wherein honeycomb cells are completely gastight.

17. Shoe according to claim 16, wherein honeycomb cells is rendered gastight by upper and lower cover layers which completely cover and close top and bottom ends of the honeycomb cells of the entire honeycomb body.

18. Shoe according to claim 3, wherein outermost peripheral partial cells of the honeycomb body area are filled with a compact unfoamed elastic material.

19. Shoe according to claim 1, wherein the honeycomb body is disposed in a midsole layer.

* * * * *